United States Patent [19]

Miller

[11] Patent Number: 5,072,079

[45] Date of Patent: Dec. 10, 1991

[54] SENSING EDGE FOR A DOOR AND METHOD OF MAKING THE SAME

[75] Inventor: Norman K. Miller, Concordville, Pa.

[73] Assignee: Miller Edge, Inc., Concordville, Pa.

[21] Appl. No.: 629,790

[22] Filed: Dec. 19, 1990

[51] Int. Cl.[5] ..... H01H 3/16

[52] U.S. Cl. ..... 200/61.43

[58] Field of Search ..... 200/61.43, 86 R, 86 A, 200/85 R; 49/27, 28

[56] References Cited

U.S. PATENT DOCUMENTS 3,321,592 5/1967 Miller ..... 200/61.43

4,972,054 11/1990 Miller et al. ..... 200/61.43

*Primary Examiner*—J. R. Scott

*Attorney, Agent, or Firm*—Panitch Schwarze Jacobs & Nadel

[57] ABSTRACT

A sensing edge for causing a closing door to open by actuating a device upon force being applied to the sensing edge. The sensing edge includes a first sheet of resiliently compressible material, a first sheet of electrically conductive material, a layer of non-conductive material, a second sheet of electrically conductive material, a second sheet of resiliently compressible material and an elongate inner core arranged in the recited order. The inner core has a predetermined elastic compressibility which is selected in accordance with the desired sensitivity of the sensing edge, such that the sensitivity of the sensing edge directly corresponds to the elastic compressibility of the inner core. The first and second sheets of flexible, electrically conductive material are spaced apart by the layer of non-conductive material and present opposed portions to each other through an opening in the layer of non-conductive material whereby upon the application of force to the sheath, the inner core compresses until its elastic compressibility is less than the elastic compressibility of said first and second layers of resiliently compressible material and said layer of non-conductive material, whereupon a portion of the first sheet of flexible, electrically conductive material deflects into the opening in the second layer of non-conductive material and into contact with a portion of the second sheet of flexible, electrically conductive material to thereby actuate the device.

2 Claims, 1 Drawing Sheet

SENSING EDGE FOR A DOOR AND METHOD OF MAKING THE SAME

FIELD OF THE INVENTION

The present invention relates to a sensing edge for a door and, more particularly, to a sensing edge for causing a closing door to open by actuating a device upon force being applied to the sensing edge.

BACKGROUND OF THE INVENTION

It is known to construct sensing edges of a flexible elongate sheath with an elongate inner core positioned therewithin, such that a chamber, which is generally U-shaped in cross section, is formed between the inner core and the sheath. Complementarily positioned within the U-shaped chamber is a standard compressible switch. The switch is comprised of a pair of compressible foam layers which sandwich a perforated foam layer. A pair of flexible, electrically conductive contacts are interposed between the perforated layer and the compressible layers, such that upon application of force to the sheath, a portion of at least one of the sheets of electrically conductive material deflects into a perforation of the perforated foam layer of material and makes electrical contact with the other of the sheets of electrically conductive material to thereby actuate the device.

In the sensing edge field, customers often require that the sensing edges have a certain sensitivity which may vary from customer to customer depending, in part, upon the desired end use of the sensing edge. In order to meet the requested sensitivity of the sensing edge, the elastic compressibility of each of the foam layers must be individually selected as well as the size and number of the perforations in the perforated layer, because the inner core is constructed of a substantially rigid material. Accordingly, a significant amount of downtime in the manufacturing process is incurred every time a change in sensitivity is required from the sensing edges then being produced. Hence, a need has arisen for the ability to change the sensitivity of the sensing edges being produced in a quick and efficient manner without incurring a significant amount of manufacturing downtime.

The present invention is directed to a sensing edge wherein the sensitivity thereof can be readily changed. The sensitivity of the sensing edge in accordance with the present invention can be readily changed by merely changing the elastic compressibility of the inner core thereof. Consequently, the present invention overcomes the problems inherent in the manufacturing of prior art sensing edges by changing the elastic compressibility of a single element of the sensing edge which results in considerable savings of money and time in the manufacturing of the sensing edge.

SUMMARY OF THE INVENTION

Briefly stated, the present invention comprises a sensing edge for actuation of a device upon force being applied to the sensing edge. The sensing edge comprises an elongate sheath compressible upon application of external pressure and adapted for attachment to a door edge. The sheath has a first internal surface and a second internal surface. An elongate inner core is positioned within the sheath. The inner core has a first external surface which complements the first internal surface of the sheath, such that a chamber which is generally U-shaped in cross section is formed between the external surface of the inner core and the internal surface of the sheath. The inner core has a predetermined elastic compressibility. The predetermined elastic compressibility of the inner core is selected in accordance with the desired sensitivity of the sensing edge such that the sensitivity of the sensing edge directly corresponds to the elastic compressibility of the inner core. The sensing edge includes a first sheet of resiliently compressible material having a first face and a second face. The first sheet of resiliently compressible material is generally U-shaped in cross section and has a predetermined elastic compressibility which is less than the elastic compressibility of the inner core. The first face of the first sheet of the resiliently compressible material is in engagement with the first internal surface of the sheath. The sensing edge further includes a first sheet of electrically conductive material having a first face and a second face. The first face of the first sheet of electrically conductive material is in engagement with the second face of the first sheet of resiliently compressible material. In engagement with the first sheet of electrically conductive material is a layer of non-conductive material having a first face and a second face. Specifically, the first face of the layer of non-conductive material is in engagement with the second face of the first sheet of electrically conductive material. The layer of non-conductive material is generally U-shaped in cross section and has a predetermined elastic compressibility which is less than the elastic compressibility of the inner core. The layer of non-conductive material includes at least one opening extending therethrough between the first and second faces thereof. In engagement with the layer of non-conductive material is a second sheet of electrically conductive material having a first face and a second face. The first face of the second sheet of electrically conductive material is in engagement with the second face of the layer of non-conductive material. The sensing edge further includes a second sheet of resiliently compressible material having a first face and a second face. The second sheet of resiliently compressible material is generally U-shaped in cross section and has a predetermined elastic compressibility which is less than the elastic compressibility of the inner core. The first face of the second sheet of resiliently compressible material is in engagement with the second face of the second sheet of electrically conductive material and the second face of said second sheet of resiliently compressible material is in engagement with the first external surface of the inner core. The second internal surface of the sheath is in engagement with a second external surface of the inner core. The first and second sheets of electrically conductive material are spaced apart by the layer of non-conductive material and present opposed portions to each other through the opening whereby upon the application of force to the sheath, a portion of at least one of the first and second sheets of electrically conductive material deflects into the opening in the layer of non-conductive material and makes electrical contact between the first and second sheets of electrically conductive material to thereby actuate the device.

BRIEF DESCRIPTION OF THE DRAWING

The foregoing summary, as well as the following detailed description of the preferred embodiment, is better understood when read in conjunction with the appended drawing. For the purpose of illustrating the invention, there is shown in the drawing an embodiment which is presently preferred, it being understood, however, that the invention is not limited to the specific methods and instrumentalities disclosed. In the drawing.

DESCRIPTION OF PREFERRED EMBODIMENT

Figure 1:
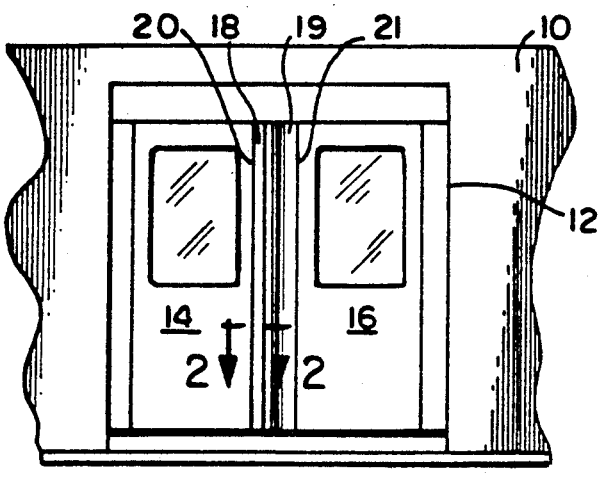
FIG. 1 is a front elevational view showing a door construction including a pair of sensing edges in accordance with the present invention.

Certain terminology is used in the following description for convenience only, and is not limiting. The words "right," "left," "lower" and "upper" designate directions in the drawing to which reference is made. The words "inwardly" and "outwardly" refer to directions toward and away from, respectively, the geometric center of the sensing edge and designated parts thereof. The terminology includes the words above specifically mentioned, derivatives thereof and words of similar import.

Figure 2:
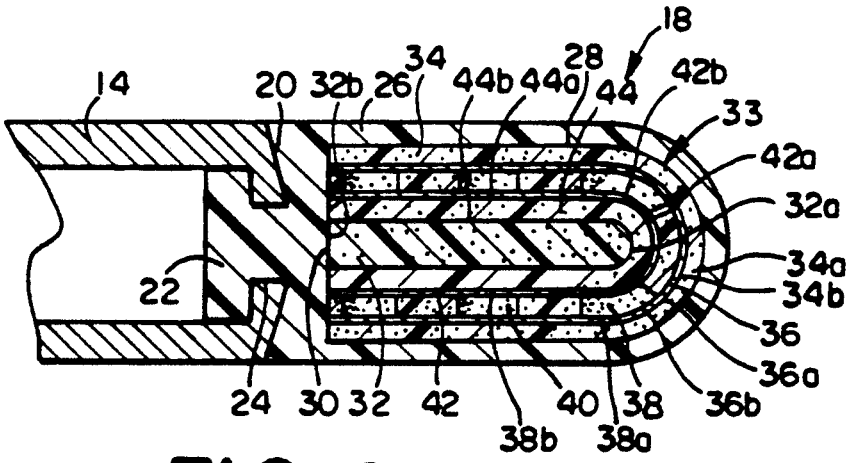
FIG. 2 is a greatly enlarged cross-sectional view of a portion of one of the doors and the sensing edge thereof taken along line 2—2 of FIG. 1.

Referring to the drawing in detail, wherein like numerals indicate like elements throughout, there is shown in FIGS. 1 and 2, a preferred embodiment of a sensing edge in accordance with the present invention. There is shown in FIG. 1, a building wall 10 having a doorway 12 provided with a first door 14 and a second door 16. The first and second doors 14, 16, as illustrated, are vertically disposed horizontally moveable doors each having a sensing edge 18, 19 in accordance with the present invention along its inner vertical edge or leading edge 20, 21, respectively. However, it is within the spirit and scope of the invention to incorporate either of the sensing edges 18, 19 described hereinafter along the edge of any door structure, such as an overhead door (not shown) as desired. Moreover, it is understood by those skilled in the art, that the sensing edges 18, 19 are not limited to use in connection with doors, but can be used for other applications, such as automatic windows.

The following description is directed to the sensing edge 18 attached to the first door 14 for convenience only. The configuration and operation of the sensing edge 19 on the second door 16 is generally identical to the sensing edge 18 on the first door 14 and, therefore, the description thereof has been omitted and is not limiting.

Referring now to FIG. 2, the sensing edge 18 and the first door 14 include securing means for fixing the sensing edge 18 to the leading edge 20 of the first door 14. In the presently preferred embodiment, the securing means is comprised of a generally T-shaped member 22 on the sensing edge 18 positioned within a complementary slot 24 extending along the vertically extending surface of the first door 14. Of course, the sensing edge 18 may be secured to the first door 14 in any other suitable manner, for instance, with a traditional dovetail slot configuration (not shown). Moreover, it is also within the spirit and scope of the invention to secure the sensing edge 18 to the leading edge 20 of the first door 14 by an adhesive (not shown) applied between the leading door edge 20 and the peripheral face of the sensing edge 18.

As shown in FIG. 2, the sensing edge 18 is comprised of an elongate outer sheath 26 compressible upon application of external pressure and fabricated of flexible air impervious material. The sheath 26 has a first internal surface 28 which is generally U-shaped in cross section and a second internal surface 30 which is generally straight or flat in cross section. It is preferred that the sheath 26 have a generally constant cross-sectional configuration, extending closely along the leading edge 20 of the first door 14. In the present embodiment, the sheath 26 is generally shaped as described above, but may be of any other suitable shapes, such as rectangular or semi-circular (not shown).

In the present embodiment, it is preferred that the sheath 26 be advantageously fabricated of a form retaining, but flexible material, such as rubber. The T-shaped member 22 is formed with the sheath 26 for releasably interconnecting engagement with the leading door edge 20, thereby facilitating quick and easy mounting, removal and/or replacement of the sensing edge 18 with respect to the first door 14.

As shown in FIG. 2, an elongate inner core 32 is positioned within the sheath 26. The inner core 32 has a first external surface 32*a* which complements the first internal surface 28 of the sheath 26 such that a chamber 33, which is generally U-shaped in cross section, is formed between the first external surface 32*a* of the inner core 32 and the first internal surface 28 of the sheath 26.

In the present embodiment, it is preferred that the inner core 32 be constructed of a foam rubber having a predetermined elastic compressibility. The predetermined elastic compressibility is selected in accordance with the desired sensitivity of the sensing edge 18, such that the sensitivity of the sensing edge 18 directly corresponds to the elastic compressibility of the inner core 32, as described in more detail hereinafter. It is understood by those skilled in the art, that the inner core 32 can be constructed of either opened or closed cell foam rubber or of other materials having similar properties.

Referring to FIG. 2, a first sheet of resiliently compressible material 34 is positioned within the chamber 33 and includes a first face 34*a* and a second face 34*b*. The first sheet of resiliently compressible material 34 is generally U-shaped in cross section. It is preferred that the first face 34*a* of the first sheet of resiliently compressible material 34 be in engagement with or corresponding facing relationship with the first internal surface 28 of the sheath 26.

In the present embodiment, it is preferred that the first sheet of resiliently compressible material 34 and succeeding layers and sheets described hereinafter, be generally sized to complement the generally U-shaped chamber 33. However, the first sheet of resiliently compressible material 34 and succeeding layers can be sized as wide or as narrow as desired, and can be of virtually any length for accommodating different structures and uses.

The first sheet of resiliently compressible material 34 is preferably constructed of generally soft foam rubber having a predetermined elastic compressibility which is less than the elastic compressibility of the inner core 32. It is understood by those skilled in the art, that the first sheet of resiliently compressible material 34 can be constructed of either closed or open cell foam rubber or of other materials having similar properties and may have an elastic compressibility equal to or greater than the elastic compressibility of the inner core 32.

Just inwardly (when viewing FIG. 2) of the first sheet of resiliently compressible material 34 is a first sheet of flexible, electrically conductive material 36, having a first face 36*a* and a second face 36*b*. The first face 36*a* of the first sheet of flexible, electrically conductive material 36 is in engagement or in corresponding facing relationship with the second face 34*b* of the first sheet of resiliently compressible material 34. In the present embodiment, it is preferred that the first sheet of flexible, electrically conductive material 36 be generally thin and preferably be constructed of aluminum or aluminum foil. However, it is within the spirit and scope of the invention to construct the first sheet of flexible, electrically conductive material of other materials, such as copper or brass or an alloy thereof.

It is preferred that an electrical conductor or wire (not shown) be electrically connected to the first sheet of flexible, electrically conductive material 36 preferably by soldering at one end thereof. The electrical conductor is used in connection with a circuit (not shown) for controlling the actuation of the device (not shown) or first door 14, as is understood by those skilled in the art, in response to the application of force to the sheath 26, as described hereinafter.

The first sheet of flexible, electrically conductive material 36 is in engagement with a layer of non-conductive material 38 having a first face 38*a* and a second face 38*b* for spacing apart the first sheet of flexible, electrically conductive material 36 and a second sheet of flexible electrically conductive material 42. The layer of non-conductive material 38 has at least one opening 40 extending therethrough between the first and second faces 38*a*, 38*b* thereof. As shown in FIG. 2, the layer of non-conductive material 38, preferably includes a plurality of openings 40 interspersed therealong for allowing the actuation of the sensing edge 18 by applying pressure thereto, as described hereinafter. The first face 38*a* of the layer of non-conductive material 38 is in engagement or corresponding facing relationship with the second face 36*b* of the first sheet of flexible, electrically conductive material 36.

In the present embodiment, it is preferred that the openings 40 be generally oval-shaped in cross section. However, it is within the spirit and scope of the invention to configure the openings 40 of any geometric shape, such as square or circular.

The layer of non-conductive material 38 is preferably generally U-shaped in cross section and is constructed of a generally soft foam rubber having a predetermined elastic compressibility which is less than the elastic compressibility of the inner core 32. It is understood by those skilled in the art, that the layer of non-conductive material 38 can be constructed of either closed or open cell foam rubber or other materials having similar properties, and may have an elastic compressibility equal to or greater than the elastic compressibility of the inner core 32 so long as the The layer of non-conductive material 38 is in engagement with a second sheet of flexible, electrically conductive material 42 having a first face 42*a* and a second face 42*b*. The first face 42*a* of the second sheet of flexible, electrically conductive material 42 is in engagement or corresponding facing relationship with the second face 38*b* of the layer of non-conductive material 38.

In the present embodiment, it is preferred that the second sheet of flexible, electrically conductive material 42 be constructed of the same material and configuration as the first sheet of flexible, electrically conductive material 36. Similarly, the second sheet of flexible, electrically conductive material 42 is connected to an electrical conductor or wire (not shown) for connection with a circuit for controlling the actuation of the first door 14 or device in response to the application of force to the sheath.

In engagement with the second sheet of flexible, electrically conductive material 42 is a second sheet of resiliently compressible material 44 having a first face 44*a* and a second face 44*b*. The first face 44*a* of the second sheet of resiliently compressible material 44 is in engagement or corresponding facing relationship with the second face 42*b* of the second sheet of flexible, electrically conductive material 42. The second face 44*b* of the second sheet of resiliently compressible material 44 is in engagement with the first external surface 32*a* of the inner core 32.

The second sheet of resiliently compressible material 44 is preferably generally U-shaped in the cross section and is preferably constructed of the same material and configured generally identical to the first sheet of resiliently compressible material 34. That is, the second sheet of resiliently compressible material 44 has a predetermined elastic compressibility which is less than the elastic compressibility of the inner core 32. However, it is apparent to those skilled in the art, that the first and second sheets of resiliently compressible material 34, 44 can differ in configuration, size, compressibility and/or material.

As shown in FIG. 2, the second internal surface 30 of the sheath 26 is in engagement with a second external surface 32*b* of the inner core 32 to provide the sensing edge 18 with structural integrity.

The first and second sheets of flexible, electrically conductive material 36, 42 are spaced apart by the layer of non-conductive material 38 and present opposed portions to each other through the openings 40. Upon the application of force to the sheath 26, a portion of at least one of the first and second sheets of flexible, electrically conductive material 36, 42 deflects into at least one of the openings 40 in the layer of non-conductive material 38, and makes electrical contact with the other of the first and second sheets of flexible, electrically conductive material 36, 42 to thereby actuate the device.

In use, the sheath 26 is connected to the first door 14 using the T-shaped member 22 as described above. The electrical conductors or wires (not shown) are connected to a circuit (not shown) for controlling the operation or actuation of a device (not shown) which controls the actuation of the first door 14 in response to the application of force to the sheath 26. Similarly, as mentioned previously, a generally identical sensing edge 19 is secured to the second door 16. Upon the application of force to either or both of the sensing edges 18, 19 along the sheath 26, a portion of at least one of the first and second sheets of flexible, electrically conductive material 36, 42 deflects into at least one of the openings 40 in the layer of non-conductive material 38 and makes electrical contact with the other of the first and second sheets of flexible, electrically conductive material 36, 42 to thereby complete or enable the circuit to actuate the device and control the actuation of either or both of the first and second doors 14 and 16. That is, the device causes the closing first and second doors 14 and 16 to open upon application of force to either of the sensing edges 18, 19.

However, as mentioned previously, in the present embodiment, it is preferred that the inner core 32 have an elastic compressibility which is greater than the elastic compressibility of the first and second layers of resiliently compressible material 34, 44 and the layer of non-conductive material 38. Thus, when a force is applied to the sheath 26 the inner core 32 begins to compress before a portion of one of the first and second sheets of flexible, electrically conductive material 36, 42 deflects into one of the openings 40 because the inner core 32 has a greater elastic compressibility than the layers 34, 38, 44. As the inner core 32 is compressed its elastic compressibility decreases. The inner core 32 continues to compress until its elastic compressibility is less than the elastic compressibility of the first and second layers of resiliently compressible material 34, 44 and the layer of non-conductive material 38. At this point, at least one of the first and second sheets of flexible, electrically conductive material 36, 42 deflects into one of the openings 40 to actuate the device. The device is actuated with a delay because the inner core 32 must first compress before the first and second sheets of flexible, electrically conductive material 36, 42 can deflect.

On the other hand, if the inner core 32 is selected with an elastic compressibility which is less than the elastic compressibility of the first and second layers of resiliently compressible material 34, 44 and the layer of non-conductive material 38 (as in the prior art sensing edges), one of the first and second sheets of flexible, electrically conductive material 36, 42 deflects into one of the openings 40 without the inner core 32 first compressing (i.e., without delay). Consequently, by selecting the elastic compressibility of the inner core 32 in accordance with the above principles, the sensitivity of the sensing edge 18 is also selected.

The method of making the sensing edge 18, comprises the steps of placing the first and second sheets of resiliently compressible material 34, 44, the first and second sheets of electrically conductive material 36, 42, and the layer of non-conductive material 38 in the arrangement described above such that each of the layers and sheets are planar and parallel with respect to each other. It is preferred that the first face 36*a* of the first sheet of electrically conductive material 36 be laminated to the second face 34*b* of the first sheet of resiliently compressible material 34 with a suitable adhesive. Similarly, it is preferred that the second face 42*b* of the second sheet of electrically conductive material 42 be laminated to the first face 44*a* of the second sheet of resiliently compressible material 44 with a suitable adhesive. However, it is understood by those skilled in the art, that above-mentioned layers and sheets could be arranged without an adhesive therebetween.

An elongated inner core 32 is selected with a predetermined elastic compressibility in accordance with the desired sensitivity of the sensing edge 18 as described above. The above combination of sheets and layers is then placed in engagement with the first external surface 32*a* of the inner core 32 by laminating the second face 44*b* of the second layer of resiliently compressible material 44 thereto with a suitable adhesive such that the sheets and layers are generally U-shaped in cross section. This assembly is then positioned within the sheath 24.

If, during manufacture, a change in the sensitivity of the sensing edge 18 being produced is desired, it is only necessary to change the elastic compressibility of the inner core 32. Thus, significant manufacturing down time is avoided.

From the foregoing description, it can be seen that the present invention comprises a sensing edge for actuation of a device upon force being applied to the sensing edge and method of making the same. It will be appreciated by those skilled in the art, that changes could be made to the embodiment described above without departing from the broad inventive concept thereof. It is understood, therefore, that this invention is not limited to the particular embodiment disclosed, but it is intended to cover all modifications which are within the spirit and scope of the invention as defined by the appended claims.

I claim:

1. A sensing edge for causing a closing door to open by actuating a device upon force being applied to . said sensing edge, said sensing edge comprising:

an elongate sheath compressible upon application of external pressure for attachment to a door edge, said sheath having a first internal surface and a second internal surface;

an elongate inner core within said sheath, said inner core having a first external surface which complements said first internal surface of said sheath such that a chamber which is generally U-shaped in cross section is formed between said external surface of said inner core and said first internal surface of said sheath, said second internal surface of said sheath being in engagement with a second external surface of said inner core, said inner core having a predetermined elastic compressibility, said predetermined elastic compressibility being selected in accordance with the desired sensitivity of the sensing edge such that the sensitivity of the sensing edge directly corresponds to the elastic compressibility of the inner core;

a first sheet of resiliently compressible material having a first face and a second face, said first sheet of resiliently compressible material being generally U-shaped in cross section and having a predetermined elastic compressibility which is less than the elastic compressibility of said inner core, said first face of the first sheet of resiliently compressible material being in engagement with said first internal surface of said sheath;

a first sheet of electrically conductive material having a first face and a second face, said first face of said first sheet of electrically conductive material being in engagement with said second face of said first sheet of resiliently compressible material;

a layer of non-conductive material having a first face and a second face, said layer of non-conductive material being generally U-shaped in cross section and having a predetermined elastic compressibility which is less than the elastic compressibility of said inner core, said first face of said layer of non-conductive material being in engagement with said second face of said first sheet of electrically conductive material, said layer of non-conductive material including at least one opening extending therethrough between said first and second faces thereof;

a second sheet of electrically conductive material having a first face and a second face, said first face of said second sheet of electrically conductive material being in engagement with said second face of said layer of non-conductive material; and a second sheet of resiliently compressible material having a first face and a second face, said second sheet of resiliently compressible material being generally U-shaped in cross section and having a predetermined elastic compressibility which is less than the elastic compressibility of said inner core, said first face of said second sheet of resiliently compressible material being in engagement with said second face of said second sheet of electrically conductive material and said second face of said second sheet of resiliently compressible material being in engagement with said first external surface of said inner core, said first and second sheets of electrically conductive material being spaced apart by said layer of non-conductive material and presenting opposed portions to each other through said opening whereby upon the application of force to said sheath, the inner core compresses until its elastic compressibility is less than the elastic compressibility of said first and second layers of resiliently compressible material and said layer of non-conductive material, whereupon a portion of at least one of said first and second sheets of electrically conductive material deflects into the opening in said layer of non-conductive material and makes electrical contact between said first and second sheets of electrically conductive material to thereby actuate the device.

2. A method of making a sensing edge for causing a closing door to open by actuating a device upon force being applied to said sensing edge, said method comprising the steps of:

providing a first sheet of resiliently compressible material having a first face, a second face and a predetermined elastic compressibility;

providing a first sheet of electrically conductive material having a first face, a second face and a predetermined elastic compressibility;

laminating said first face of said first sheet of electrically conductive material to said second face of said first sheet of resiliently compressible material;

providing a layer of non-conductive material having a first face, a second face and a predetermined elastic compressibility;

providing said layer of non-conductive material with at least one opening extending therethrough between said first and second faces thereof;

placing said first face of said layer of nonconductive material in engagement with said second face of said first sheet of electrically conductive material;

providing a second sheet of electrically conductive material having a first face, a second face and a predetermined elastic compressibility;

placing said first face of said second sheet of electrically conductive material in engagement with said second face of said layer of non-conductive material;

providing a second sheet of resiliently compressible material having a first face, a second face, and a predetermined elastic compressibility;

laminating said first face of said second sheet of resiliently compressible material to said second face of said second sheet of electrically conductive material;

selecting an elongated inner core having a first external surface and a predetermined elastic compressibility in accordance with the desired sensitivity of the sensing edge, said predetermined elastic compressibility of said first sheet of resiliently compressible material, layer of non-conductive material and second sheet of resiliently compressible material being less than the predetermined elastic compressibility of said inner core;

laminating said external surface of said inner core to said second face of said second sheet of resiliently compressible material;

providing an elongated sheath compressible upon application of external pressure and fabricated of flexible material for attachment to a door edge and having a chamber positioned therein having a first internal surface and a second internal surface;

placing said first sheet of resiliently compressible material, said first sheet of electrically conductive material, said layer of non-conductive material, said second sheet of electrically conductive material, said second sheet of resiliently compressible material and said elongate inner core within said chamber of said sheath such that the first face of the first sheet of resiliently compressible material is in complementary engagement with said first internal surface of said sheath, said first and second sheets of flexible, electrically conductive material being spaced apart by said layer of non-conductive material to present opposed portions to each other through said opening, whereby upon application of force to said sheath, the inner core compresses until its elastic compressibility is less than the elastic compressibility of said first and second layers of resiliently compressible material and said layer of non-conductive material, whereupon a portion of said first sheet of flexible, electrically conductive material deflects into the opening in said layer of non-conductive material and into contact with a portion of said second sheet of flexible, electrically conductive material to thereby actuate the device.

* * * * *